US009745974B2

(12) United States Patent
Phillips et al.

(10) Patent No.: US 9,745,974 B2
(45) Date of Patent: Aug. 29, 2017

(54) PUMP USING MULTI VOLTAGE ELECTRONICS WITH RUN DRY AND OVER CURRENT PROTECTION

(71) Applicant: Flow Control LLC, Beverly, MA (US)

(72) Inventors: David L. Phillips, Groveland, MA (US); Humberto V. Meza, Tustin, CA (US); Derrick T. Tran, Yorba Linda, CA (US)

(73) Assignee: FLOW CONTROL LLC, Beverly, MA (US)

( * ) Notice: Subject to any disclaimer, the term of this patent is extended or adjusted under 35 U.S.C. 154(b) by 586 days.

(21) Appl. No.: 14/265,587

(22) Filed: Apr. 30, 2014

(65) Prior Publication Data

US 2014/0322029 A1 Oct. 30, 2014

Related U.S. Application Data

(63) Continuation-in-part of application No. 13/708,075, filed on Dec. 7, 2012.

(60) Provisional application No. 61/818,147, filed on May 1, 2013, provisional application No. 61/567,960, filed on Dec. 7, 2011.

(51) Int. Cl.
*F04B 17/03* (2006.01)
*F04B 49/06* (2006.01)

(52) U.S. Cl.
CPC ..... *F04B 49/06* (2013.01); *F04B 17/03* (2013.01); *F04B 49/065* (2013.01); *F04B 2201/0207* (2013.01); *F04B 2203/0201* (2013.01); *F04B 2203/0202* (2013.01)

(58) Field of Classification Search
CPC ..... F04B 17/03; F04B 49/065
See application file for complete search history.

(56) References Cited

U.S. PATENT DOCUMENTS 3,407,739 A * 10/1968 Myers ..... F04D 7/02 415/201
3,953,152 A 4/1976 Sipin
4,221,543 A 9/1980 Cosentino et al.
(Continued)

FOREIGN PATENT DOCUMENTS

CN 1897451 A 1/2007
CN 101990730 A 3/2011
(Continued)

OTHER PUBLICATIONS

English Language Abstract of CN101990730A.
English Language Abstract of CN1897451A.

*Primary Examiner* — Thienvu Tran
*Assistant Examiner* — Pinping Sun
(74) *Attorney, Agent, or Firm* — Ware, Fressola, Maguire & Barber LLP

(57) ABSTRACT

A pump system features a power adapter and a pump having a signal processor. The power adapter includes voltage settings that respond to a voltage setting by a user and provide a selected voltage. The signal processor receives signaling containing information about the selected voltage supplied to a motor to run the pump, and also containing information about whether a current draw of the pump is lower than a predetermined low current level or is higher than a predetermined high current level; and determines whether to shut off the pump after a predetermined time, based on the signaling received.

23 Claims, 8 Drawing Sheets

(56) References Cited

U.S. PATENT DOCUMENTS

| | | | | |
|---|---|---|---|---|
| 4,420,787 | A | 12/1983 | Tibbits et al. | |
| 4,473,856 | A * | 9/1984 | Takahashi | H02H 7/0833 361/31 |
| 4,841,404 | A | 6/1989 | Marshall et al. | |
| 5,076,761 | A | 12/1991 | Krohn et al. | |
| 5,076,763 | A | 12/1991 | Asastos et al. | |
| 5,577,890 | A | 11/1996 | Nielsen et al. | |
| 6,227,806 | B1 | 5/2001 | Libfeld | |
| 6,280,170 | B1 * | 8/2001 | Furuya | B29C 45/82 425/145 |
| 6,390,780 | B1 | 5/2002 | Batchelder et al. | |
| 6,414,455 | B1 | 7/2002 | Watson | |
| 6,481,973 | B1 | 11/2002 | Struthers | |
| 6,625,519 | B2 | 9/2003 | Goodwin et al. | |
| 6,675,989 | B1 * | 1/2004 | Ritter | B60S 1/481 137/558 |
| 6,873,131 | B1 | 3/2005 | Watkins et al. | |
| 6,998,807 | B2 * | 2/2006 | Phillips | F04B 17/03 318/455 |
| 7,080,508 | B2 | 7/2006 | Stavale et al. | |
| 7,352,550 | B2 | 4/2008 | Mladenik et al. | |
| 7,393,185 | B2 | 7/2008 | Scanderbeg et al. | |
| 7,407,371 | B2 | 8/2008 | Leone et al. | |
| 7,442,014 | B1 | 10/2008 | Mellinger et al. | |
| 7,690,897 | B2 | 4/2010 | Branecky et al. | |
| 7,821,215 | B2 | 10/2010 | Koehl | |
| 2002/0176782 | A1 | 11/2002 | Batchelder et al. | |
| 2004/0088797 | A1 | 5/2004 | Darby | |
| 2004/0213676 | A1 | 10/2004 | Phillips et al. | |
| 2004/0265135 | A1 | 12/2004 | Carboneri et al. | |
| 2006/0130504 | A1 | 6/2006 | Agrawal et al. | |
| 2006/0164773 | A1 * | 7/2006 | Stanford | H04L 49/351 361/93.1 |
| 2008/0018112 | A1 | 1/2008 | Kleen | |
| 2009/0064698 | A1 | 3/2009 | Spanger | |
| 2009/0213515 | A1 | 8/2009 | Phillips et al. | |
| 2010/0237161 | A1 | 9/2010 | Sandahl | |
| 2011/0255992 | A1 * | 10/2011 | Tran | F04B 49/065 417/1 |
| 2013/0343907 | A1 | 12/2013 | Phillips et al. | |

FOREIGN PATENT DOCUMENTS

| | | |
|---|---|---|
| EP | 1255174 | 11/2002 |
| EP | 1914427 | 4/2008 |
| EP | 2246569 | 11/2010 |
| EP | 2262073 | 12/2010 |
| WO | 2009108467 | 9/2009 |

* cited by examiner

A pump 10

A signal processor 12, including where the signal processor forms part of a printed circuit board assembly (PCBA), configured to:

receive signaling containing information about a voltage being supplied to a motor to run a particular pump model, and also containing information about whether a current draw of the pump is lower than a predetermined low current level or is higher than a predetermined high current level;

determine whether to shut off the pump after a predetermined time, based at least partly on the signaling received; and/or provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

Other pump components and parts 14 that do not form part of the underlying invention, e.g., including a motor, on/off switch, power supply jack, pressure switch.

Figure 1

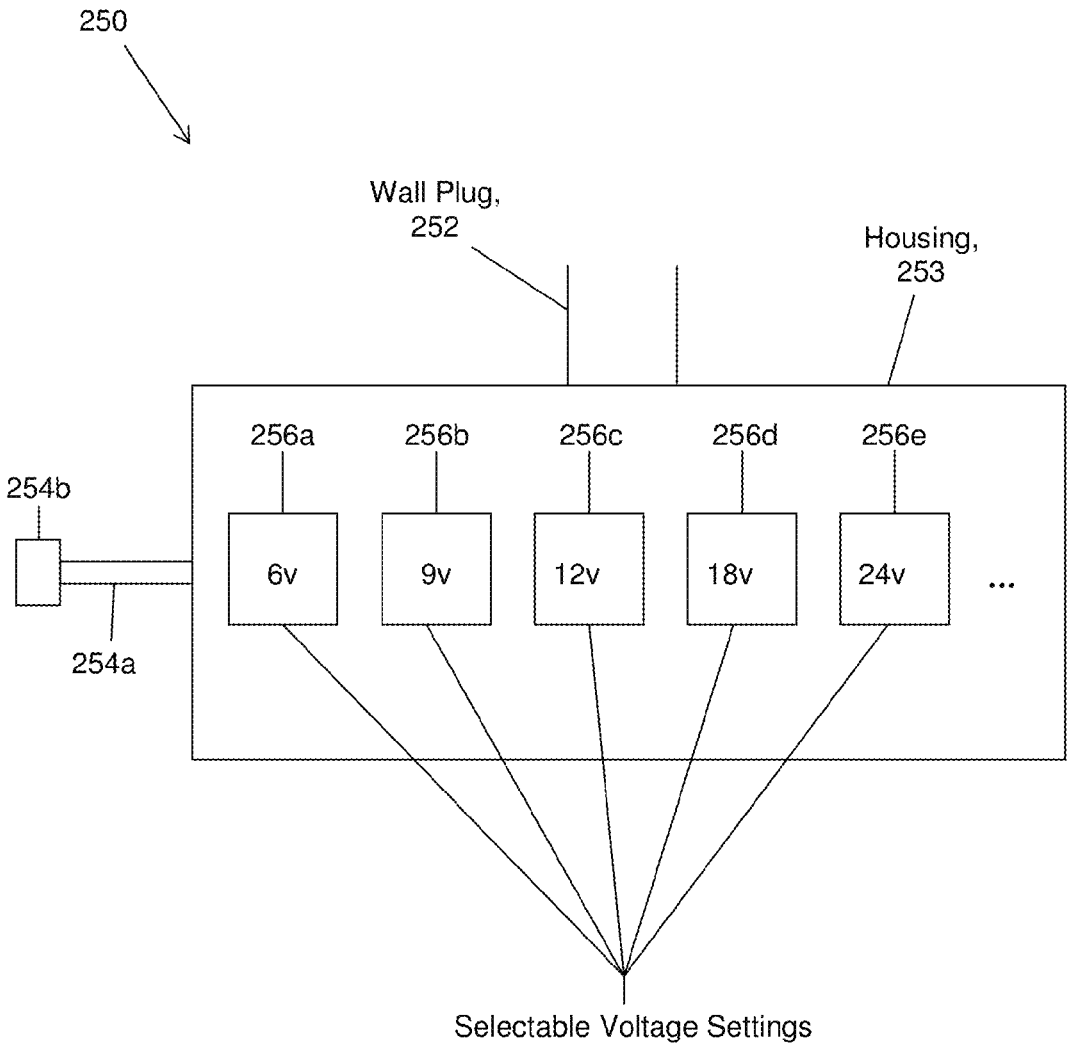
Figure 8: Power Adapter

PUMP USING MULTI VOLTAGE ELECTRONICS WITH RUN DRY AND OVER CURRENT PROTECTION

CROSS-REFERENCE TO RELATED APPLICATIONS

This application claims benefit to provisional patent application Ser. No. 61/818,147, filed 1 May 2013, and is a continuation-in-part (CIP) of U.S. patent application Ser. No. 13/708,075, filed 7 Dec. 2012, which claims benefit to provisional patent application Ser. No. 61/567,960, filed 7 Dec. 2011, which are all incorporated by reference in their entirety.

BACKGROUND OF THE INVENTION

1. Field of Invention

The present invention relates to a pump; and more particularly to a pump using multi voltage electronics and multiple voltage settings for providing run dry and over current protection to a particular pump model, as well as providing multiple flow rate depending on a selected voltage setting.

2. Description of Related Art

Most pumps in the markets are usually voltage specific with motors for each voltage. When the pump is running and the fluid is exhausted, there is either a float switch/level switch to shut the pump off that is externally mounted to a container or tank, or the pump simply continues to run until it is damaged or shut off manually.

Some shortcomings of these known pump designs include the fact that multiple pump models are required for different voltages. Moreover, when the pumps run dry, they are often damaged and require maintenance.

SUMMARY OF THE INVENTION

In summary, by utilizing an electronic printed circuit board assembly (PCBA) internal to a pump, one is able to accept 12/24/(possibly 32V+ as well) VDC as well as utilize an external wall mounted power supply to convert 115/230 VAC to run one pump model. The PCBA may also contain software features and controller functionality that protect against run dry and over current situations to protect not only the electronics but the pump as a whole.

By way of example, and according to some embodiments, the present invention may include, or take the form of, apparatus such as a pump featuring a signal processor, including where the signal processor forms part of a printed circuit board assembly (PCBA), configured to:

- receive signaling containing information about a voltage being supplied to a motor to run a particular pump model, and also containing information about whether a current draw of the pump is lower than a predetermined low current level or is higher than a predetermined high current level; and
- determine whether to shut off the pump after a predetermined time, based at least partly on the signaling received.

The signal processor, including the PCBA, may also be configured to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

The present invention may include one or more of the following features:

The signal processor, including the PCBA, may be configured to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model.

The signal processor, including the PCBA, may be configured to provide the control signalling to shut the pump off in order to protect the pump against a run dry and/or over current conditions of the pump.

The control signalling may include blinking a rocker lamp if the current draw of the pump is either lower than the predetermined low current level or higher than the predetermined high current level.

The signal processor, including the PCBA, may be configured, programmed or adapted to run on the particular pump model having one input voltage, and may also be configured, programmed or adapted to run on a different particular pump model having a different input voltage. For example, the signal processor, including the PCBA, may be configured with a respective software routine for each particular pump model, and implement the appropriate software routine based at least partly on the voltage being supplied to the motor to run the particular pump model. In effect, the PCBA may be configured universally to run on numerous pump models.

The particular pump model forms part of a series of pumps having different voltage requirements, including a 12 volt pump, a 24 volt pump, or a 32 volt pump, etc. In the series of pumps, each particular pump model has a respective motor having a corresponding voltage requirement.

The pump may contain the PCBA inside its housing.

The Method

The present invention may also take the form of a method including steps for receive signaling containing information about a voltage being supplied to a motor to run a particular pump model, and also containing information about whether a current draw of the pump is lower than a predetermined low current level or is higher than a predetermined high current level; and determining whether to shut off the pump after a predetermined time, based at least partly on the signaling received.

The method may also include providing control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model, as well as one or more of the other features set forth above.

The Pump System

According to some embodiments, the present invention may take the form of a pump system featuring a power adapter in combination a pump having a signal processor, including where the signal processor forms part of a printed circuit board assembly (PCBA). The power adapter may include voltage settings, each configured to be set by a user to provide a selected voltage. The signal processor may be configured to receive signaling containing information about the selected voltage being supplied to a motor to run the pump, and also containing information about whether a current draw of the pump is lower than a predetermined low current level or is higher than a predetermined high current level; and determine whether to shut off the pump after a predetermined time, based at least partly on the signaling received.

The pump system may include one or more of the following features:

Each voltage setting may correspond to a respective flow rate of the pump.

The voltage settings may include at least two voltage settings, e.g., selected from a group that includes a 6 volt setting, a 9 volt setting, a 12 volt setting, an 18 volt setting and a 24 volt setting.

The PCBA may be configured to receive sensed signaling from some combination of a fluid supply sensor, a pressure sensor, a fluid level sensor, and determine whether to shut off the pump after the predetermined time, based at least partly on the sensed signaling received, including when the fluid supply sensor, the pressure sensor or the fluid level sensor is activated.

The signal processor may be configured to implement a start-up process, e.g., including detecting the selected voltage being supplied to the motor.

The start-up process may include priming the pump at the selected voltage; and either shutting off the pump after the predetermined time if the pump does not prime, or running the pump if the pump does prime.

The signal processor may be configured to implement a normal operating mode process, e.g., including continuing to run the pump if the pump does prime; determining if the pump experiences a low current draw by comparing a sensed current being drawn by the pump to a respective predetermined low current value corresponding to the selected voltage detected; and shutting off the pump after the predetermined time if the sensed current is less than the respective predetermined low current value.

The normal operating mode process may also include, e.g., continuing to run the pump if the pump primes; determining if the pump experiences a high current draw by comparing a sensed current being drawn by the pump to a predetermined high current value; and shutting off the pump after the predetermined time if the sensed current is greater than the predetermined high current value.

The predetermined high current value may include, or take the form of, a respective predetermined high current valve corresponding to the selected voltage detected.

The predetermined high current value may also include, or take the form of, a single high current value for any selected voltage detected.

The fluid supply sensor may be configured to sense a fluid supply, and provide a fluid supply signal containing information about the fluid supply, including when the fluid supply is empty.

The pressure sensor may be configured to sense a fluid pressure, and provide a fluid pressure signal containing information about the fluid pressure.

The fluid level sensor may be configured to sense a fluid level, and provide a fluid level signal containing information about the fluid level.

The pump may include an on/off switch having an integrated light. The integrated light may be configured to receive light control signaling and either turn on when the pump is running or blink when the pump shuts off. The signal processor may be configured to provide the light control signaling.

The pump may be configured to contain the power adapter so as form an integral pump system. For example, the power adapter may be configured in the pump's housing with suitable selectable voltage settings adapted to extend outside and external to the housing for selecting by the user.

Possible applications may include, e.g., bag-in-box fluid transfer, bottled water dispensers, coffee machine auto-refill, beverage dispensers, general fluid transfer, water pressure systems, or chemical spraying systems.

BRIEF DESCRIPTION OF THE DRAWING

The drawing includes FIGS. 1-8, which are not necessarily drawn to scale, as follows:

FIG. 1 is a block diagram of pump, according to some embodiments of the present invention.

FIG. 8 is a block diagram of a power adapter having selectable voltage settings, according to some embodiments of the present invention.

DETAILED DESCRIPTION OF BEST MODE OF THE INVENTION

FIGS. 1-4 show embodiments that formed part of the aforementioned parent patent application Ser. No. 13/708,075; and FIGS. 5-8 show embodiments that formed part of the aforementioned provisional patent application Ser. No. 61/818,147, and which now form the basis for this CIP patent application.

FIG. 1: The Basic Pump 10

By way of example, FIG. 1 shows the present invention in the form of a pump generally indicated as 10 that includes a signal processor, including where the signal processor forms part of a printed circuit board assembly (PCBA) 12, configured to receive signaling containing information about a voltage being supplied to a motor to run a particular pump model, and also containing information about whether a current draw of the pump is lower than a predetermined low current level or is higher than a predetermined high current level; and determine whether to shut off the pump after a predetermined time, based at least partly on the signaling received.

Figure 2:
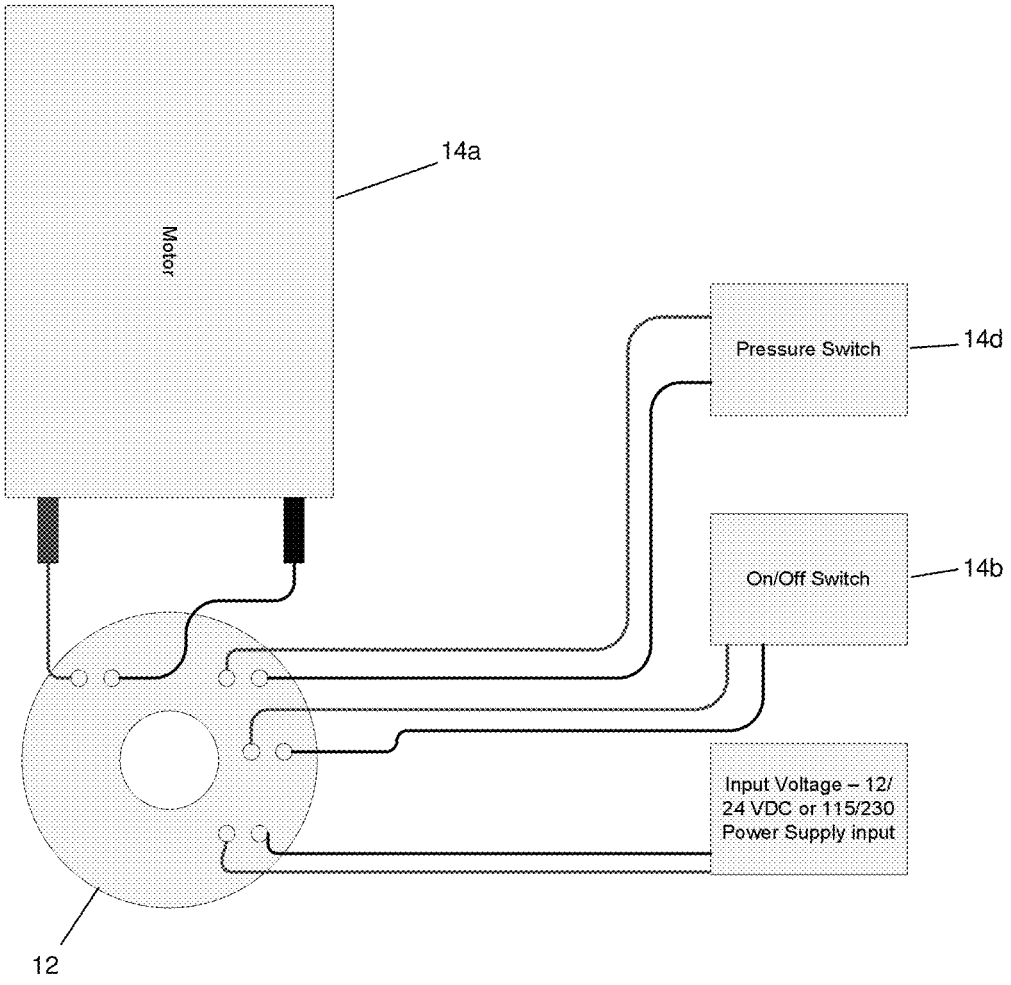
FIG. 2 is a block diagram of components that form part of a pump, according to some embodiments of the present invention.
Figure 3:
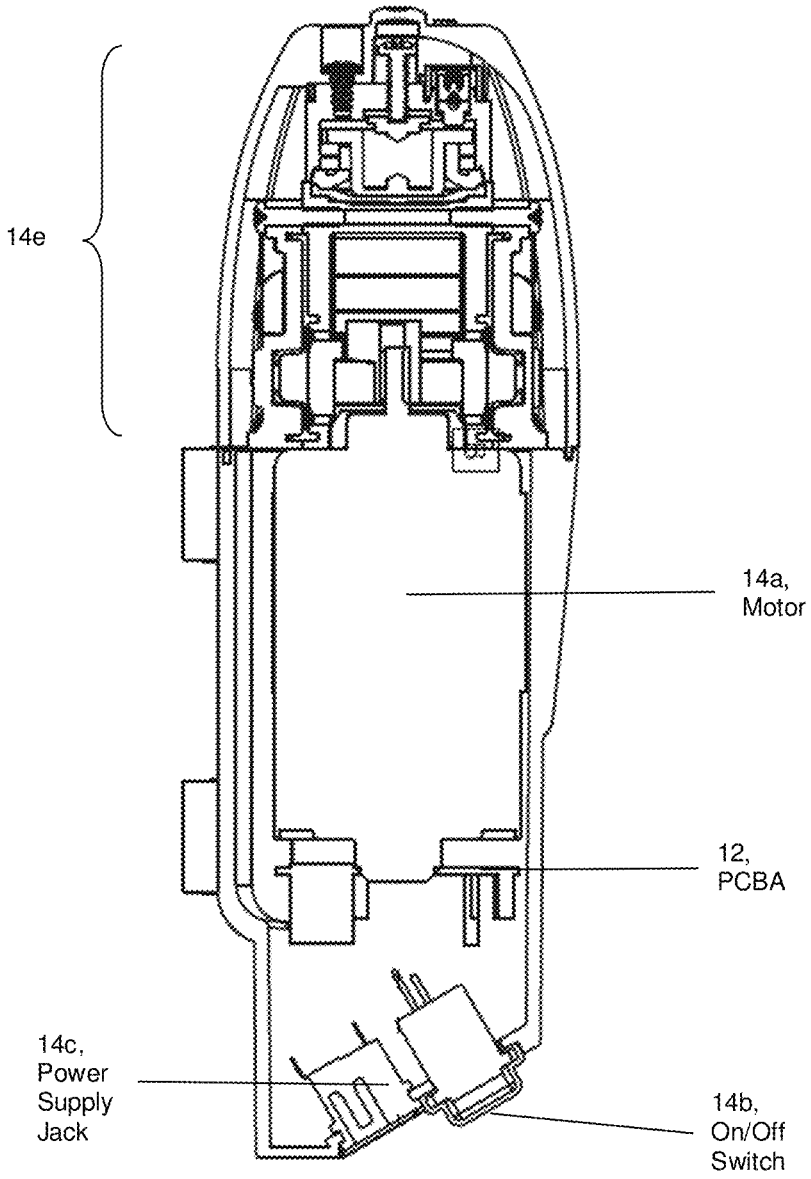
FIG. 3 is a cross sectional view of a pump, according to some embodiments of the present invention.

The pump 10 may also include other pump components and parts generally indicated as 14 in FIG. 1 that do not form part of the underlying invention, e.g., including a motor 14*a*, on/off switch 14*b*, a power supply jack 14*c*, a pressure switch 14*d* and a front end pumping portion 14*e*, as shown in FIGS. 2 and 3. The power supply jack 14*c* is configured for receiving or accepting 12/24/(possibly 32V+ as well) VDC as well as utilize an external wall mounted power supply to convert 115/230 VAC to run one pump model. The pressure switches like element 14*d* are known in the art, may be configured to sense the pressure of fluid being pumped, and provide corresponding signaling, e.g. to turn off the pump if the sensed pressure exceeds some predetermined pumping pressure. Front end pumping portion like element generally indicated as element 14*e* may be configured for pumping the fluid or liquid of interest by the pump 10 and are known in the art, such that the scope of the invention is not intended to be limited to any particular type, kind or configuration of the same.

The signal processor, including the PCBA 12, may be configured to provide control signalling to shut off the pump 10 after the predetermined time, e.g., if the current draw of the pump 10 is lower than the predetermined low current level or is higher than the predetermined high current level, where the predetermined low current level and the predetermined high current level depend on the voltage being supplied to the motor 14*a* (FIG. 2) to run the particular pump model. For example, the control signalling may contain information for turning or switching off the motor 14*a*.

Figure 4:
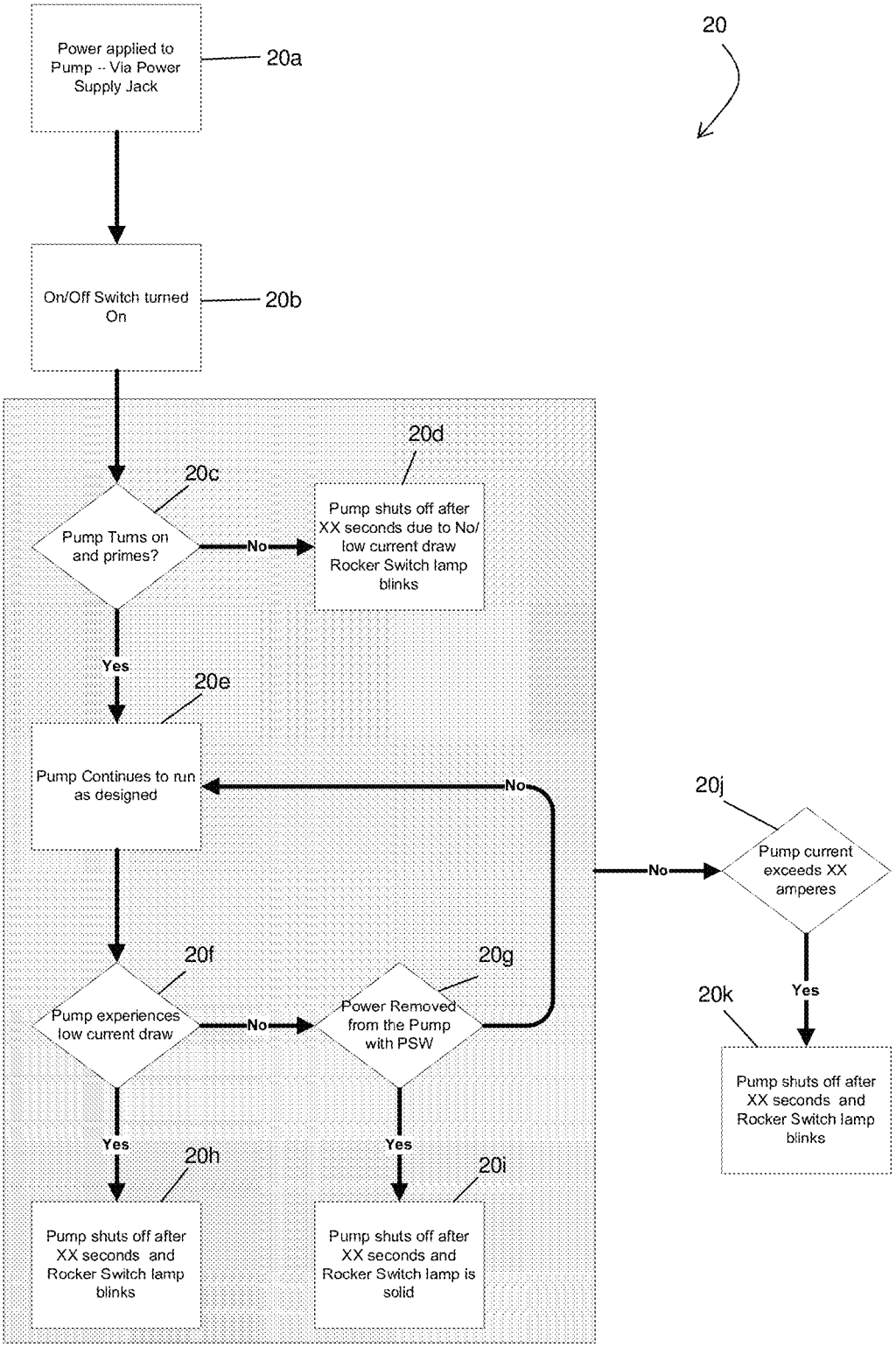
FIG. 4 is a block diagram of a flowchart for providing run dry and over current protection, according to some embodiments of the present invention.
Figure 5:
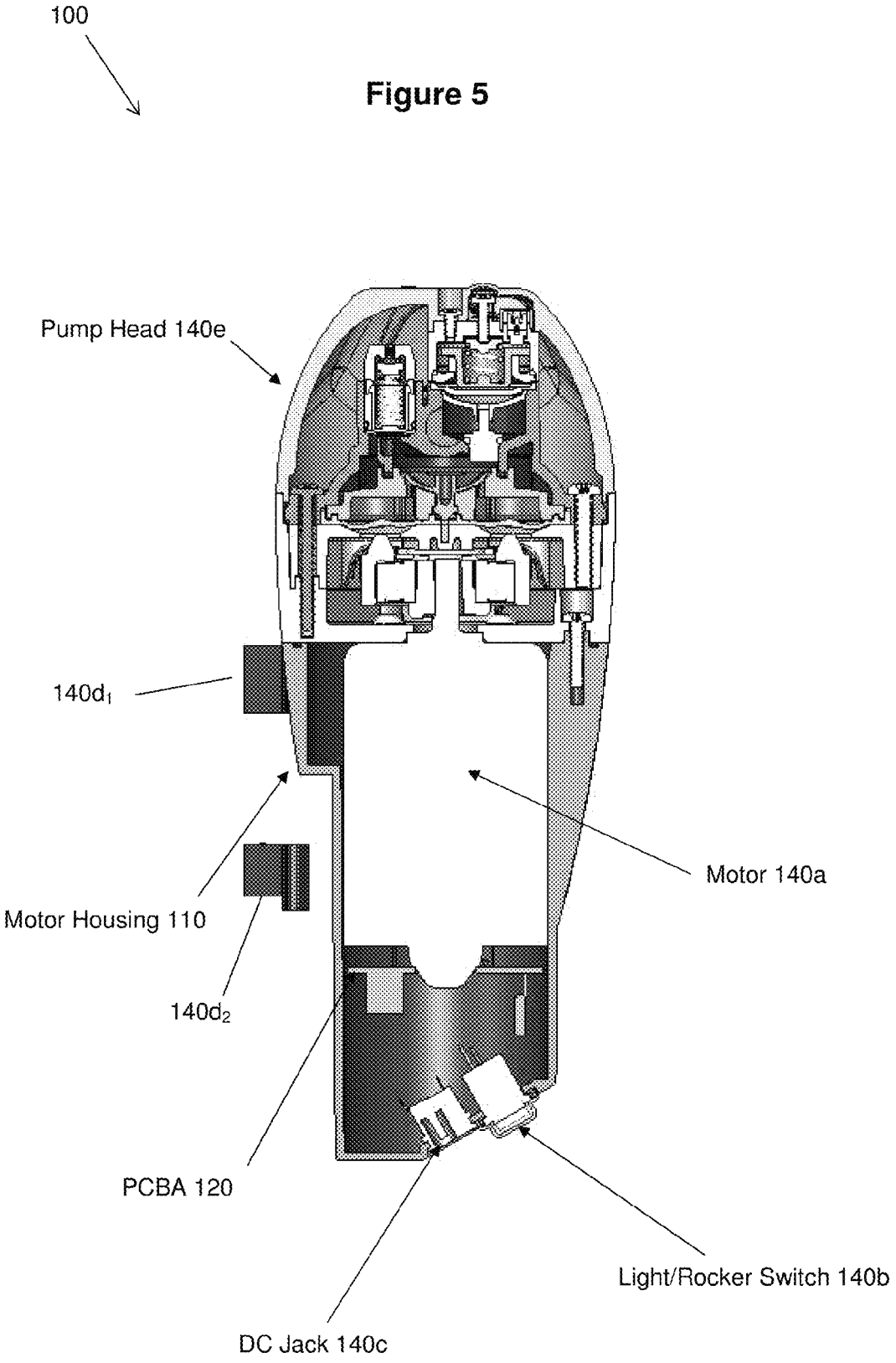
FIG. 5 is a diagram of a pump, according to some embodiments of the present invention.

The signal processor, including the PCBA 12, may be configured to provide the control signalling to shut the pump 10 off in order to protect the pump 10 against a run dry and/or over current conditions of the pump, consistent with the pump control routine generally indicated as 20 shown in FIG. 4. For example, see steps 20*d*, 20*h* and 20*k*.

The control signalling may include blinking a rocker lamp when if the current draw of the pump is either lower than the predetermined low current level or higher than the predetermined high current level, consistent with the pump control routine 20 shown in FIG. 4. Again, see the steps 20*d*, 20*h* and 20*k*. The control signalling may include turning a rocker lamp solid when power is removed from the pump 10. See steps 20*g* and 20*i*.

The signal processor, including the PCBA 12, may be configured and programmed to run on the particular pump model having one input voltage, and may also be configured, programmed and/or suitably to run on a different particular pump model having a different input voltage for running a pump motor.

The signal processor, including the PCBA 12, may be configured with at least one processor and at least one memory including computer program code, the at least one memory and computer program code configured, with the at least one processor, to cause the signal processor to receive the signaling containing information about the voltage being supplied to the motor to run the particular pump model, and also containing information about whether the current draw of the pump is lower than the predetermined low current level or is higher than the predetermined high current level; and determine whether to shut off the pump after the predetermined time, based at least partly on the signaling received.

The present invention may also take the form of a method including steps for receive signaling containing information about a voltage being supplied to a motor such as 14*a* (FIG. 2) to run a particular pump model, and also containing information about whether a current draw of the pump 10 is lower than a predetermined low current level or is higher than a predetermined high current level; and determining whether to shut off the pump after a predetermined time, based at least partly on the signaling received.

By way of example, the direct current voltage may be in a range of about 12-32 volts; and the alternating current voltage may be in a corresponding range of about 115/230 volts, although the scope of the invention is not intended to be limited to any particular voltage or voltage range.

Signal Processor 12

By way of example, and consistent with that described herein, the functionality of the signal processor, device or module and/or PCBA 12 may be implemented to receive the signaling, process the signaling therein and/or provide the control signaling, using hardware, software, firmware, or a combination thereof, although the scope of the invention is not intended to be limited to any particular embodiment thereof. In a typical software implementation, the signal processor, including the PCBA 12, may include, or take the form of, one or more microprocessor-based architectures having a microprocessor, a random access memory (RAM), a read only memory (ROM), input/output devices and control, data and address busing architecture connecting the same. A person skilled in the art would be able to program such a microprocessor-based implementation to perform the functionality set forth herein, as well as other functionality described herein without undue experimentation. The scope of the invention is not intended to be limited to any particular implementation using technology either now known or later developed in the future. Moreover, the scope of the invention is intended to include a signal processor as either part of the aforementioned apparatus, as a stand alone module, or in the combination with other circuitry for implementing another module.

Techniques for receiving signaling in such a signal processor, device, module or PCBA like element 12 are known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like element 12 without undue experimentation so as to receive the signaling containing information about a voltage being supplied to a motor to run a particular pump model, and also containing information about whether a current draw of the pump is lower than a predetermined low current level or is higher than a predetermined high current level, consistent with that set forth herein.

Techniques for determining signaling from other signaling are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like element 12 without undue experimentation so as to determine whether to shut off the pump after a predetermined time, based at least partly on the signaling received.

Techniques for providing signaling a signal processor such as element 12 are also known in the art, and the scope of the invention is not intended to be limited to any particular type or kind thereof either now known or later developed in the future. Based on this understanding, a person skilled in the art would appreciate, understand and be able to implement and/or adapt the signal processor, device, module or PCBA like 12 without undue experimentation so as to provide control signalling to shut off the pump after the predetermined time if the current draw of the pump is lower than the predetermined low current level or is higher than the predetermined high current level, where the predetermined low current level and the predetermined high current level depend on the voltage being supplied to the motor to run the particular pump model, consistent with that set forth herein.

It is also understood that the apparatus 10 may include one or more other modules, components, processing circuits, or circuitry 14 for implementing other functionality associated with the underlying apparatus that does not form part of the underlying invention, and thus is not described in detail herein. By way of example, the one or more other modules, components, processing circuits, or circuitry may include random access memory, read only memory, input/output circuitry and data and address buses for use in relation to implementing the signal processing functionality of the signal processor, or devices or components, etc.

FIG. 4 The Method

FIG. 4 shows a flowchart generally indicated as 20 having steps 20*a*, 20*b*, 20*c*, . . . , 20*j* and 20*k* for operating the pump 10, including for providing run dry and over current protection controller functionality, according to some embodiments of the present invention. In addition to the controller functionality set forth in FIG. 4, the signal processor, including the PCBA 12, may be configured to execute a time out in order to turn the pump off, e.g., including in order to prevent the pump from emptying a container or reservoir of liquid if there should be any leaks in the system as a whole. By way of example, the executed time out feature may take the form of a predetermined time out, e.g., which may be set at 5 minutes and can be set for anytime, that is a safety feature to prevent the pump from emptying the container or reservoir of a fluid. The executed time out feature may also be used as a safety shutoff in general. Based on the flowchart in FIG. 4 and steps 20*a*, 20*b*, 20*c*, . . . , 20*j* and 20*k* set forth therein, a person skilled in the art would understand, appreciate and be able to program the signal processor, including the PCBA 12, with a computer program to implement the control functionality to run the particular pump model according to the present invention.

Applications

The present invention may also be used in, or form part of, or used in conjunction with, any fluid handling application. The scope of the invention is also not intended to be limited to being implemented in any particular type or kind of pump either now known or later developed in the future, and may include diaphragm pumps, positive displacement pumps, etc.

Pump with Multiple Voltage Inputs for Various Flow/Pressure Rates, Multiple Feedback Devices, Run-dry & Time Out Capability

DESCRIPTION OF OTHER PRIOR ART DEVICES

Typical diaphragm pumps known in the art are designed with single voltage/power input and deliver a specific flow/pressure rate, have no feedback input or limited to one type (typically a mechanical pressure switch or similar). Some disadvantages of these prior art pumps include the following: Limited applications, flow rates and pressures are not adjustable, and they are not capable of different device/sensor input. Multiple motor/pump combinations are needed to achieve different flows and pressures.

Summary of Additional Features

According to some embodiments of the present invention, the pump can have the capability to accept various voltage inputs (6/9/12/18/24 vdc) through a power adaptor. This will allow users to select different flow rates for their applications. Different types of sensors can be integrated with the pump to monitor fluid supply, pressure, fluid level, etc. Reverse polarity, over-current, run-dry and time-out protections may also be integrated in the printed circuit board assembly (PCBA) and control algorithm software.

FIGS. 5-8: Detailed Description of Additional Features

The following sets forth additional features that may be used in conjunction with that disclosed in the aforementioned parent application, e.g., including that shown and described in relation to FIGS. 1-4 herein.

The Pump System

Figure 6:
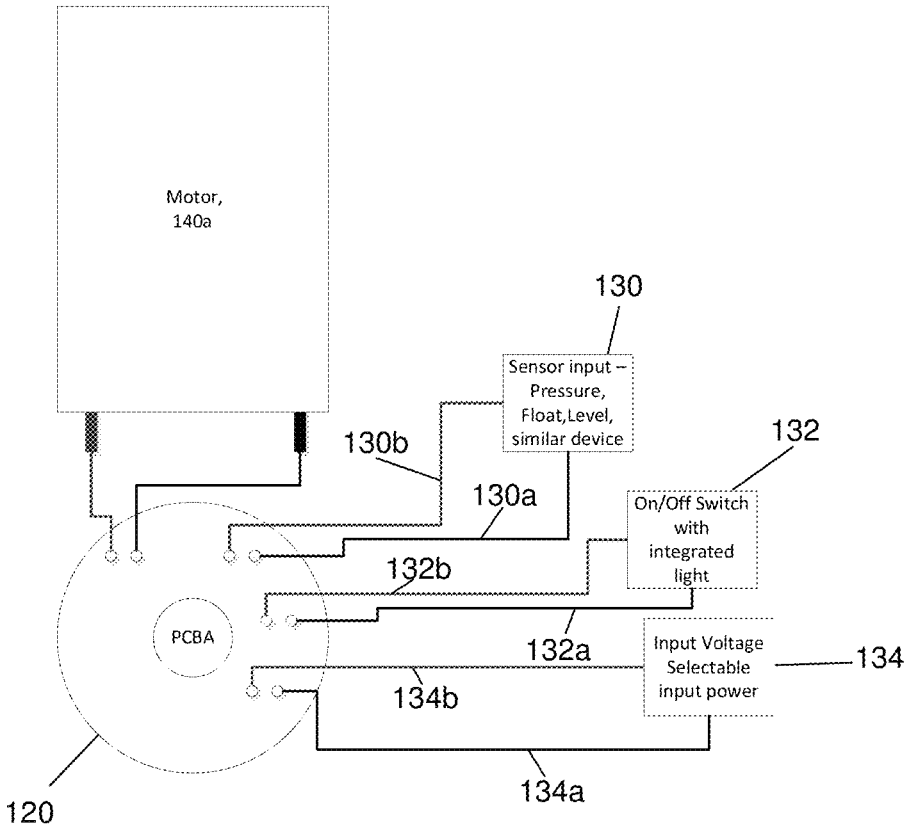
FIG. 6 is a block diagram of components that form part of, or cooperate with, a pump, including a motor, sensor input devices, an on/off switch and a module for receiving input voltage as selectable input power, according to some embodiments of the present invention.

FIGS. 5-8 show a pump system featuring a power adapter 250 (FIG. 8) in combination a pump 100 (FIG. 5) having a signal processor, e.g., which may take the form of element 12 in FIG. 1, and/or which may form part of a printed circuit board assembly (PCBA) 120 (FIG. 6).

The pump 100 may include a motor housing 110, the PCBA 120, a motor 140*a*, a light/rocker switch 140*b*, a DC jack 140*c*, mounting legs 140$d_1$, 140$d_2$ and a pump head 140*e*. By way of example, as shown the pump 100 may be configured as a diaphragm pump, and the pump head 140*e* may include standard diaphragm components, including a diaphragm, a wobbler plate, reciprocating pistons, check valves, etc., all of which would be appreciated by one skilled in the art. The pump head 140*e* is not described in detail since it does not form part of the point of novelty of the underlying invention. Moreover, the scope of the invention is not intended to be limited to implementations related only to diaphragm pumps, e.g., embodiments are envisioned implementing the present invention using other types or kinds of pumps either now known or later developed in the future, e.g., including positive displacement pumps, etc.

Consistent with that shown in FIG. 8, the power adapter 250 may include selectable voltage settings 256*a*, 256*b*, 256*c*, 256*d*, 256*e*, each configured to be set by a user so as to provide a selected voltage, e.g., to the motor 140*a* of the pump 100. By way of example, the selectable voltage settings 256*a*, 256*b*, 256*c*, 256*d*, 256*e* may be a push button switch type, a slide/toggle switch type, etc. The power adapter 250 may also include a wall plug 252 having prongs, as shown in FIG. 8, e.g., for plugging into a standard wall socket (not shown), and a housing 253 for containing the electronics associated with the selectable voltage settings 256*a*, 256*b*, 256*c*, 256*d*, 256*e*. The power adapter 250 may also include a cord 254*a* and a coupler 254*b* for plugging into the DC jack 140*c* (FIG. 5) of the pump 100. A person skilled in the art would be able to configured or implement such a power adapter without undue experimentation consistent with that disclosed herein, as well as that known in the prior art. Moreover, the scope of the invention is not intended to be limited to any particular type or kind of power adapter either now know or later developed in the future.

Embodiments are also envisioned in which the pump 100 may be configured to contain in its housing a power adapter so as form an integrated pump system. For example, a power adapter like element 250 may be configured in the pump's housing, e.g., in the motor housing 110 (FIG. 5), with suitable selectable voltage settings like voltage settings 256*a*, 256*b*, 256*c*, 256*d*, 256*e* adapted to extend outside and external to the pump's housing for selecting by a user. In such an integrated pump system, e.g., the housing 253 (FIG. 8) and the pump's housing, e.g., the motor housing 110 (FIG. 5), may be configured as one integral unit.

In operation, the signal processor may be configured to receive signaling containing information about the selected voltage, e.g., received from the power adapter 250 (FIG. 8), being supplied to the motor 140*a* to run the pump 100, and also containing information about whether a current draw of the pump 100 is lower than a predetermined low current level or is higher than a predetermined high current level; and determine whether to shut off the pump 100, e.g., after a predetermined time, based at least partly on the signaling received.

Selectable Voltage Settings

By way of example, the voltage settings 256*a*, 256*b*, 256*c*, 256*d*, 256*e* may include at least two voltage settings, e.g., selected from a group that includes a 6 volt setting, a 9 volt setting, a 12 volt setting, an 18 volt setting and a 24 volt setting. The scope of the invention is not intended to be limited to any particular voltage setting(s); and embodiments are envisioned using other types of voltage settings either now known or later developed in the future, e.g., including a 32 volt setting, depending on the particular application of the present invention.

Each voltage setting 256*a*, 256*b*, 256*c*, 256*d*, 256*e* may correspond to a respective flow rate of the pump. For example, the 6 volt setting may correspond to a first flow rate; the 9 volt setting may correspond to a second flow rate, e.g., that is higher than the first flow rate; the 12 volt setting may correspond to a third flow rate, e.g., that is higher than the second flow rate; the 18 volt setting may correspond to a fourth flow rate, e.g., that is higher than the third flow rate; and the 24 volt setting may correspond to a fifth flow rate, e.g., that is higher than the fourth flow rate. The scope of the invention is not intended to be limited to any particular flow rate(s); and embodiments are envisioned using other types of flow rate(s) either now known or later developed in the future, e.g., depending on the particular application of the present invention.

By way of example, voltage signaling received by the DC jack 140*c* (FIG. 5) of the pump 100 from the coupler 154*b* of the power adapter 250 may be received and processed by the module 134 for receiving the input voltage as selectable input power shown in FIG. 6, and the voltage signaling may be provided from the module 134 to the PCBA 120 via leads 134*a*, 134*b*.

Sensors 130

Consistent with that shown in FIG. 6, and by way of example, the PCBA 120 may be configured to receive sensed signaling from one or more sensors 130, e.g., including some combination of a fluid supply sensor, a pressure sensor, a fluid level sensor, and determine whether to shut off the pump 100 after the predetermined time, based at least partly on the sensed signaling received, including when the fluid supply sensor, the pressure sensor or the fluid level sensor is activated. In particular, the fluid supply sensor may be configured to sense a fluid supply, and provide a fluid supply signal containing information about the fluid supply, including when the fluid supply is empty or exhausted. The pressure sensor may be configured to sense a fluid pressure, and provide a fluid pressure signal containing information about the fluid pressure. The fluid level sensor may be configured to sense a fluid level, and provide a fluid level signal containing information about the fluid level. The PCBA 120 may be coupled to the one or more sensors using leads 130*a*, 130*b*, and the sensed signaling may be received along the leads 130*a*, 130*b*. The scope of the invention is not intended to be limited to any particular sensor(s); and embodiments are envisioned using other types of sensor(s) either now known or later developed in the future, e.g., depending on the particular application of the present invention. Moreover, fluid supply sensors, pressure sensors, and fluid level sensors are known in the art, and the scope of the invention is not intended to be limited to any particular type or kind thereof either now known or later developed in the future.

On/Off Switch 132

Consistent with that shown in FIG. 6, and by way of example, the pump 100 may include an on/off switch 132, e.g., having an integrated light. The integrated light may be configured to receive light control signaling and either turn on when the pump 100 is running or blink when the pump 100 shuts off. The signal processor may be configured to provide the light control signaling, e.g., via leads 132*a*, 132*b*, coupling the on/off switch 132 and the PCBA 120 together. The scope of the invention is not intended to be limited to any particular on/off switch; and embodiments are envisioned using other types or kinds of on/off switch either now known or later developed in the future, e.g., depending on the particular application of the present invention, including a light switch having LED lighting. Moreover, on/off switches, e.g., having an integrated light, are known in the art, and the scope of the invention is not intended to be limited to any particular type or kind thereof either now known or later developed in the future.

Start-Up Process and Normal Operating Mode

Figure 7:
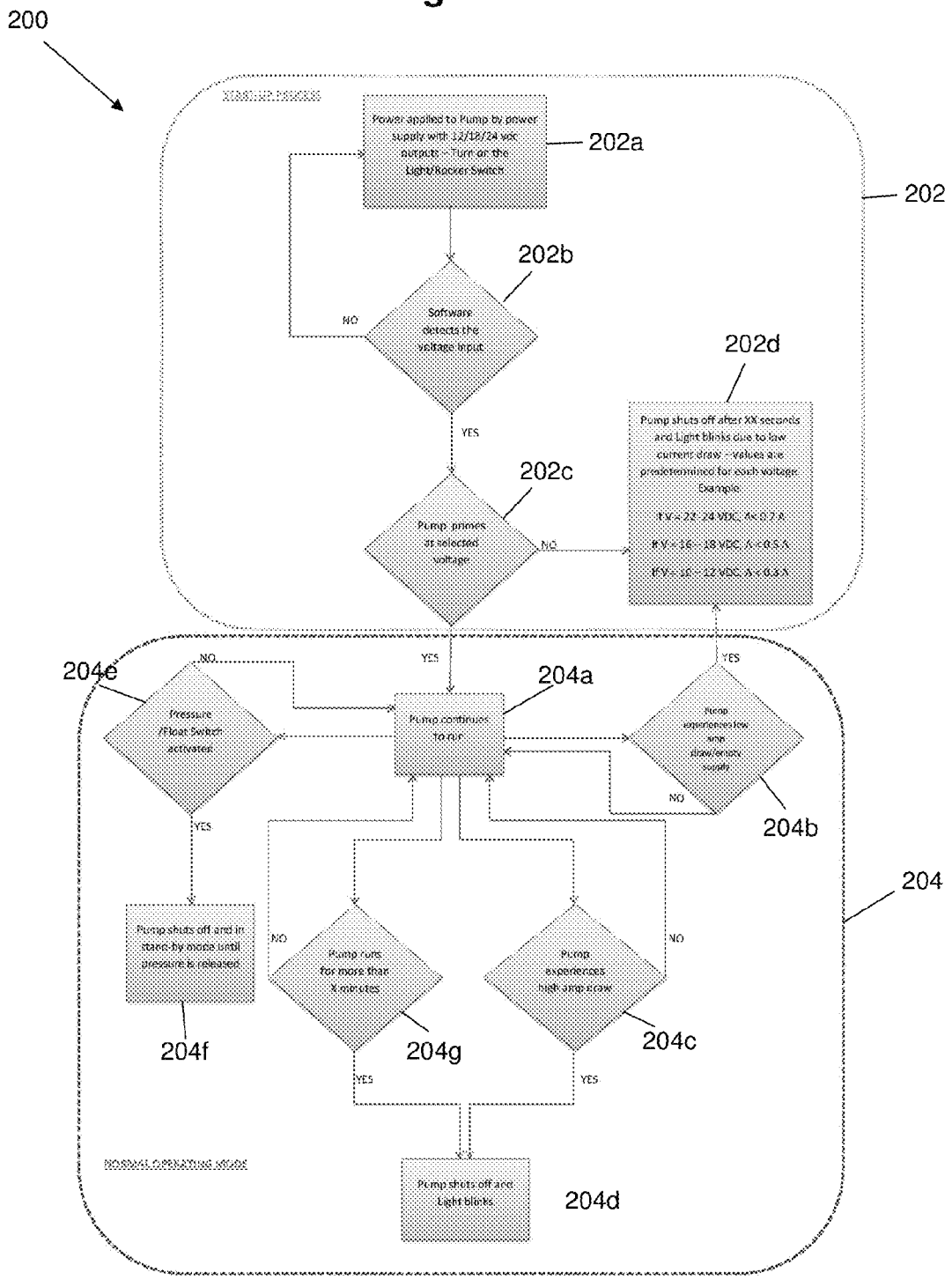
FIG. 7 is a block diagram of a flowchart for a control algorithm, e.g., having a start-up process and a normal operating mode, according to some embodiments of the present invention.

Consistent with that shown in FIG. 7, the signal processor may be configured to implement a control algorithm 200, e.g., that may include a start-up process 202 and/or a normal operating mode 204.

The Start-Up Process 202

By way of example, the signal processor may be configured to implement the start-up process 202, e.g., including using one or more steps 202*a*, 202*b*, 202*c* and 202*d*.

In step 202*a*, power may be applied to the pump 100 by the power adapter 250 (FIG. 8), e.g., in the form of an voltage setting output corresponding to the selectable voltage setting 256*a*, 256*b*, 256*c*, 256*d*, 256*e* and provided from the coupler 254*b* of the power adapter 250 to the DC jack 140*c* of the pump 100. By way of example, step 202*a* may include the user plugging in the power adapter 250 into a wall socket (not shown), plugging the coupler 254*b* of the power adapter 250 into the DC jack 140*c* of the pump 100, and selecting one of the selectable voltage setting 256*a*, 256*b*, 256*c*, 256*d*, 256*e* to determine what voltage setting output will be provided by the power adapter 250 to the motor 140*a* of the pump 100.

In step 202*b*, the signal processor may be configured to implement the control algorithm software for detecting the selected voltage being supplied to the motor 140*a*. If the signal processor does not detect the selected voltage being supplied to the motor 140*a*, then step 202*a* may need to be re-implemented, e.g., by the user. Algorithms for detecting a voltage being supplied to a motor are known in the art, and the scope of the invention is not intended to be limited to any particular type or kind thereof either now known or later developed in the future. Moreover, one skilled in the art would be able to implement such an algorithm for detecting such a voltage being supplied to such a motor like motor 140*a* without undue experimentation based on that disclosed in the instant patent application.

In step 202*c*, the signal processor may be configured to implement the control algorithm software for priming the pump 100 at the selected voltage. The control algorithm software may be configured to prime the pump 100 based on the selected voltage, e.g., using a different control algorithm for each different selected voltage. Alternatively, the control algorithm software may be configured to prime the pump 100, e.g., using one standard implementation for priming for each different selected voltage. Algorithms for priming pumps are known in the art, and the scope of the invention is not intended to be limited to any particular type or kind thereof either now known or later developed in the future. Moreover, one skilled in the art would be able to implement such an algorithm for priming such a pump like pump 100 without undue experimentation based on that disclosed in the instant patent application.

In step 202*d*, the signal processor may be configured to implement the control algorithm software for either shutting off the pump 100 after the predetermined time if the pump 100 does not prime, or running the pump 100 if the pump 100 does prime. Algorithms for shutting off pumps after a predetermined time if a pump does not prime, or running the pump if the pump does prime, are known in the art, and the scope of the invention is not intended to be limited to any particular type or kind thereof either now known or later developed in the future. Moreover, one skilled in the art would be able to implement such an algorithm for shutting off or running such a pump like pump 100 without undue experimentation based on that disclosed in the instant patent application.

The Normal Operating Mode Process 204

The signal processor may be configured to implement the normal operating mode process, e.g., including using one or more steps 204*a*, 204*b*, 204*c*, 204*d*, 204*e*, 204*f* and 204*g*.

In step 204*a*, the signal processor may be configured to implement the control algorithm software for continuing to run the pump 100 if the pump 100 primes. Algorithms for running pumps if the pumps prime are known in the art, and the scope of the invention is not intended to be limited to any particular type or kind thereof either now known or later developed in the future. Moreover, one skilled in the art would be able to implement such an algorithm for running such a pump like pump 100 without undue experimentation based on that disclosed in the instant patent application.

In step 204*b*, the signal processor may be configured to implement the control algorithm software for determining if the pump 100 experiences a low current draw by comparing a sensed current being drawn by the pump 100 to a respective predetermined low current value corresponding to the selected voltage detected. By way of example, if the selected voltage is in the range of 10-12 volts, then the respective predetermined low current value may be about 0.3 amps; if the selected voltage is in the range of 16-18 volts, then the respective predetermined low current value may be about 0.5 amps; and if the selected voltage is in the range of 22-24 volts, then the respective predetermined low current value may be about 0.7 amps. Algorithms for determining if pumps experience a low current draw by comparing sensed current drawn to some predetermined current value are known in the art, and the scope of the invention is not intended to be limited to any particular type or kind thereof either now known or later developed in the future. Moreover, one skilled in the art would be able to implement such an algorithm for making such a determination for such a pump like pump 100 without undue experimentation based on that disclosed in the instant patent application.

If the determination in step 204*a* is yes, then the signal processor may be configured to implement the control algorithm software associated with step 202*d*, e.g., for shutting off the pump 100 after the predetermined time if the sensed current is less than the respective predetermined low current value, including blinking the light on the on/off switch 132, consistent with that set forth above. By way of example, if the selected voltage is in the range of 10-12 volts, and the sensed current being drawn by the pump 100 is less than about 0.3 amps, then the signal processor may be configured to shut the pump 100 off and blink the light on the on/off switch 132, e.g., by sending suitable control signaling to the pump 100 and the on/off switch 132. Alternatively, if the selected voltage is in the range of 16-18 volts, and the sensed current being drawn by the pump 100 is less than about 0.5 amps, then the signal processor may be configured to shut the pump 100 off and blink the light on the on/off switch 132. Alternatively, if the selected voltage is in the range of 22-24 volts, and the sensed current being drawn by the pump 100 is less than about 0.7 amps, then the signal processor may be configured to shut the pump 100 off and blink the light on the on/off switch 132. If the determination in step 204*b* is no, then the signal processor may be configured to implement the control algorithm software to continue to run the pump 100, consistent with step 204*a*. Algorithms for shutting off pumps and/or blinking lights are known in the art, and the scope of the invention is not intended to be limited to any particular type or kind thereof either now known or later developed in the future. Moreover, one skilled in the art would be able to implement any such an algorithm for operating such a pump like pump 100 without undue experimentation based on that disclosed in the instant patent application.

In step 204*c*, the signal processor may be configured to implement the control algorithm software for determining if the pump 100 experiences a high current draw by comparing a sensed current being drawn by the pump 100 to a predetermined high current value, e.g. including a respective predetermined high current value corresponding to the selected voltage detected. The functionality may form part of so-called over current protection and functionality. Embodiments are envisioned in which the predetermined high current value depends on the selected voltage, as well as in which one predetermined high current value is used for any selected voltage. If the determination in step 204*c* is no, then the signal processor may be configured to implement the control algorithm software to continue to run the pump

100, consistent with that set forth in relation to step 204*a*. Algorithms for determining if pumps experience a high current draw by comparing sensed current drawn to some predetermined current value are known in the art, and the scope of the invention is not intended to be limited to any particular type or kind thereof either now known or later developed in the future. Moreover, one skilled in the art would be able to implement such an algorithm for making such a determination for such a pump like pump 100 without undue experimentation based on that disclosed in the instant patent application.

If the determination in step 204*c* is yes, then in step 204*d* the signal processor may be configured to implement the control algorithm software for shutting off the pump, e.g., after the predetermined time, if the sensed current is greater than the respective predetermined high current value, e.g., consistent with that set forth in relation to step 202*d*.

In step 204*e*, the signal processor may be configured to implement the control algorithm software to determine if one or more of the sensors 130, e.g., including some combination of a fluid supply sensor, a pressure sensor, a fluid level sensor, is activated. If the determination in step 204*e* is yes, then in step 204*f* the signal processor may be configured to implement the control algorithm software for shutting off the pump, e.g., after the predetermined time, consistent with that set forth in relation to step 202*d*. The functionality may form part of so-called run-dry functionality, e.g., when the liquid being pumped has been exhausted. Moreover, the signal processor may be configured to implement the control algorithm software to put the pump 100 in a standby mode, e.g., until pressure is released from the pump 100. If the determination in step 204*e* is no, then the signal processor may be configured to implement the control algorithm software to continue to run the pump 100, consistent with that set forth in relation to step 204*a*. Algorithms for determining if sensors are activated, e.g., including some combination of a fluid supply sensor, a pressure sensor, a fluid level sensor, are known in the art, and the scope of the invention is not intended to be limited to any particular type or kind thereof either now known or later developed in the future. Moreover, one skilled in the art would be able to implement such an algorithm for making such a determination for such a pump like pump 100 without undue experimentation based on that disclosed in the instant patent application.

In step 204*g*, the signal processor may be configured to implement the control algorithm software to determine if the pump 100 runs for more than a predetermined time, e.g., including a number of predetermined minutes. The functionality may form part of so-called time-out capability and functionality. If the determination in step 204*g* is yes, then in step 204*d* the signal processor may be configured to implement the control algorithm software for shutting off the pump 100, e.g., after the predetermined time, consistent with that set forth in relation to step 202*d*. If the determination in step 204*g* is no, then the signal processor may be configured to implement the control algorithm software to continue to run the pump 100, consistent with that set forth in relation to step 204*a*. Algorithms for determining how long a pump is running are known in the art, and the scope of the invention is not intended to be limited to any particular type or kind thereof either now known or later developed in the future. Moreover, one skilled in the art would be able to implement such an algorithm for making such a determination for such a pump like pump 100 without undue experimentation based on that disclosed in the instant patent application.

Possible applications may include, e.g., bag-in-box fluid transfer, bottled water dispensers, coffee machine auto-refill, beverage dispensers, general fluid transfer, water pressure systems, or chemical spraying systems.

THE SCOPE OF THE INVENTION

While the invention has been described with reference to an exemplary embodiment, it will be understood by those skilled in the art that various changes may be made and equivalents may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A pump system comprising:

a power adapter having voltage settings, each voltage setting configured to be set by a user to provide a selected voltage corresponding to a different flow rate selected by the user for a particular application, the power adapter configured to respond to a voltage setting selected and provide the selected voltage corresponding to the voltage setting selected by the user; and a pump configured to accept various input voltages corresponding to the voltage setting selected and operate the pump at the different flow rate for the particular application based upon the selected voltage received, the pump having a signal processor, including where the signal processor forms part of a printed circuit board assembly (PCBA), the signal processor configured to:

receive signaling containing information about the selected voltage being supplied to a motor to run the pump, and also containing information about whether a current draw of the pump is lower than a first predetermined current level corresponding to the selected voltage or is higher than a second predetermined current level corresponding to the selected voltage, the first predetermined current level being lower than the second predetermined current level to determine a range corresponding to the voltage setting selected; and determine corresponding signaling containing information about whether to shut off the pump after a predetermined time for providing run dry and over current protection controller functionality, based at least partly on the signaling received.

2. A pump system according to claim 1, wherein each voltage setting corresponds to a respective flow rate of the pump.

3. A pump system according to claim 1, wherein the voltage settings include at least two voltage settings selected from a group that includes a 6 volt setting, a 9 volt setting, a 12 volt setting, an 18 volt setting and a 24 volt setting.

4. A system pump according to claim 1, wherein the PCBA is configured to receive sensed signaling from a fluid supply sensor, or a pressure sensor, or a fluid level sensor, and determine whether to shut off the pump after the predetermined time, based at least partly on the sensed signaling received, including when the fluid supply sensor, the pressure sensor or the fluid level sensor is activated.

5. A pump system according to claim 4, wherein the fluid supply sensor is configured to sense a fluid supply, and provide a fluid supply signal containing information about the fluid supply, including when the fluid supply is empty.

6. A pump system according to claim 5, wherein the integrated light is configured to receive light control signaling and either turn on when the pump is running or blink when the pump shuts off.

7. A pump system according to claim 4, wherein the pressure sensor is configured to sense a fluid pressure, and provide a fluid pressure signal containing information about the fluid pressure.

8. A pump system according to claim 7, wherein the signal processor is configured to provide the light control signaling.

9. A pump system according to claim 4, wherein the fluid level sensor is configured to sense a fluid level, and provide a fluid level signal containing information about the fluid level.

10. A pump system according to claim 1, wherein the signal processor is configured to implement a start-up process comprising:

detecting the selected voltage being supplied from the power adapter to the motor.

11. A pump system according to claim 10, wherein the start-up process comprises:

priming the pump at the selected voltage; and either shutting off the pump after the predetermined time if the pump does not prime, or running the pump if the pump does prime.

12. A pump system according to claim 10, wherein the signal processor is configured to implement a normal operating mode process comprising:

determining if the pump experiences a first current draw by comparing a sensed current being drawn by the pump to a respective first predetermined current value corresponding to the selected voltage detected; and shutting off the pump after the predetermined time if the sensed current is less than the respective first predetermined current value.

13. A pump system according to claim 12, wherein the normal operating mode process includes:

determining if the pump experiences a second current draw by comparing the sensed current being drawn by the pump to a predetermined second current value; and shutting off the pump after the predetermined time if the sensed current is greater than the predetermined second current value.

14. A pump system according to claim 10, wherein the normal operating mode process includes:

determining if the pump experiences a second current draw by comparing a sensed current being drawn by the pump to a predetermined second current value; and shutting off the pump after the predetermined time if the sensed current is greater than the predetermined second current value.

15. A pump system according to claim 14, wherein the predetermined second current value is a respective predetermined second current value corresponding to the selected voltage detected.

16. A pump system according to claim 14, wherein the predetermined second current value is a single second current value for any selected voltage detected.

17. A pump system according to claim 1, wherein the signal processor is configured to implement a normal operating mode process comprising:

determining if the pump experiences a first current draw by comparing a sensed current being drawn by the pump to a respective first predetermined current value corresponding to the selected voltage; and shutting off the pump after the predetermined time if the sensed current is less than the respective first predetermined current value.

18. A pump system according to claim 17, wherein the normal operating mode process includes:

determining if the pump experiences a second current draw by comparing the sensed current being drawn by the pump to a predetermined second current value; and shutting off the pump after the predetermined time if the sensed current is greater than the respective predetermined second current value.

19. A pump system according to claim 1, wherein the normal operating mode process includes:

determining if the pump experiences a second current draw by comparing a sensed current being drawn by the pump to a predetermined second current value; and shutting off the pump after the predetermined time if the sensed current is greater than the respective predetermined second current value.

20. A pump system according to claim 1, wherein the pump comprises an on/off switch having an integrated light.

21. A pump system according to claim 1, wherein the pump system is configured as an integral pump system so that the pump contains the power adapter.

22. A pump system according to claim 21, wherein the pump comprises a housing, including a motor housing; and the voltage settings are adapted to extend outside and external to the housing of the pump to be selected by the user.

23. A pump system according to claim 1, wherein the signal process is configured to provide the corresponding signaling as control signaling to shut off the pump after the predetermined time for providing the run dry and over current protection controller functionality.

* * * * *